US010779664B2

(12) United States Patent
LaHera

(10) Patent No.: US 10,779,664 B2
(45) Date of Patent: Sep. 22, 2020

(54) CNH DONUT PILLOW

(71) Applicant: Arlene Francis LaHera, Port St. Lucie, FL (US)

(72) Inventor: Arlene Francis LaHera, Port St. Lucie, FL (US)

( * ) Notice: Subject to any disclaimer, the term of this patent is extended or adjusted under 35 U.S.C. 154(b) by 0 days.

(21) Appl. No.: 16/234,526

(22) Filed: Dec. 27, 2018

(65) Prior Publication Data

US 2020/0205504 A1 Jul. 2, 2020

(51) Int. Cl.
*A47G 9/10* (2006.01)

(52) U.S. Cl.
CPC ..... *A47G 9/10* (2013.01)

(58) Field of Classification Search
CPC .... A42B 3/16; A47G 9/10; A47G 2009/1018; A47G 9/1045; A47G 9/109
USPC ..... D6/601
See application file for complete search history.

(56) References Cited

U.S. PATENT DOCUMENTS 1,580,210 A * 4/1926 McCulloch ..... A47G 9/10 5/644
2,111,147 A * 3/1938 Antone ..... A61F 11/06 2/209
2,295,906 A * 9/1942 Lacour ..... A47G 9/10 5/636
3,141,179 A * 7/1964 McLean ..... A47C 21/003 5/642
3,299,451 A * 1/1967 Trogdon ..... A47G 9/10 5/640
3,574,397 A * 4/1971 Norriss ..... A61F 5/30 297/391
3,848,281 A * 11/1974 Mathews ..... A47G 9/10 5/636
3,858,257 A * 1/1975 Young ..... A47G 9/10 5/636
5,261,134 A * 11/1993 Matthews ..... A47D 13/083 5/630
5,519,906 A * 5/1996 Fanto-Chan ..... A47C 20/027 5/631
5,579,551 A * 12/1996 Tommaney ..... A47G 9/10 128/845
D394,978 S * 6/1998 Smith ..... D6/331
5,836,024 A * 11/1998 Uglehus ..... A47C 20/023 5/636
6,052,848 A * 4/2000 Kelly ..... A47C 20/021 5/630
6,052,850 A * 4/2000 Salido ..... A47G 9/10 5/644

(Continued)

*Primary Examiner* — Kristen Matter

(57) ABSTRACT

CNH Donut is a pressure and pain relieving prosthesis, and sleep aid, to be used with a standard pillow, for persons suffering with Chondrodermatitis nodularis chronic helicis, (CNH) Invention is a novel assemblage, comprised of 2 contiguous foam strips, curved into a "lachrymiform" shape, covered in cylindrical nylon spandex, then affixed with a headstrap, allowing patients to sleep directly on the injured ear, to roll over, and sleep on their preferred side, without pain. Invention is lightweight, yet firm enough to support a head. The smaller size, and unique "contiguous" placement of thick foam bands, as opposed to stuffing or fill, creates CNH Donut's distinctive strength, and "teardrop shaped" inner circle, using the natural arc, and firm properties of the foam to best advantage.

3 Claims, 4 Drawing Sheets

(56) References Cited

U.S. PATENT DOCUMENTS 6,363,285 B1 * 3/2002 Wey ..... A61F 9/02 607/100
6,408,468 B1 * 6/2002 Comfort ..... A47G 9/10 5/498
6,546,579 B1 * 4/2003 Leventhal ..... A47C 27/081 297/452.41
6,920,881 B2 * 7/2005 Narula ..... A61F 5/0195 128/889
7,141,032 B2 * 11/2006 Flam ..... A61F 13/069 602/61
D582,045 S * 12/2008 James ..... D24/191
7,461,424 B2 * 12/2008 Lindell ..... A47G 9/10 428/304.4
8,863,338 B2 * 10/2014 Dzioba ..... A61G 7/05776 5/655.3
8,887,732 B2 * 11/2014 Choi ..... A61F 13/069 128/845
D728,272 S * 5/2015 Zimmerman ..... D6/601
9,220,345 B2 * 12/2015 Davis ..... A47C 7/62
9,433,309 B2 * 9/2016 Cheng ..... A47G 9/1054
D773,212 S * 12/2016 Krishtul ..... D6/601
D804,852 S * 12/2017 Glaze ..... D6/601
10,111,526 B2 * 10/2018 Davis ..... A47C 7/62
D835,431 S * 12/2018 Bice ..... D6/601
2008/0304691 A1 * 12/2008 Lai ..... H04R 5/0335 381/386
2011/0225735 A1 * 9/2011 Heroux ..... A47G 9/10 5/640
2013/0117939 A1 * 5/2013 Moss ..... A47G 9/10 5/644
2014/0352069 A1 * 12/2014 Verde Sanchez ... A61F 5/05891 5/636
2015/0107025 A1 * 4/2015 Dauphin ..... A47C 7/383 5/638
2017/0095096 A1 * 4/2017 Mandell ..... A47C 15/00
2018/0213954 A1 * 8/2018 Grinstead ..... A47G 9/10

* cited by examiner

CNH DONUT PILLOW

BACKGROUND OF THE INVENTION

The invention is a small, toroidal shaped, pressure relieving, ear protecting, prosthesis, and sleep aid, to be used in conjunction with a standard pillow, especially for patients diagnosed with CNH.

Chondrodermatitis nodularis chronic helicis, (CNH or CHCH) is a very common, benign, condition of the helix or anti-helix of the ear, affecting persons in their middle 60's and 70's, and believed to be caused by sleeping on the same side nightly. CNH is similar to a decubitus ulcer, but smaller, sometimes only a pinpoint. CNH identifies itself, by being extraordinarily painful. CNH shows signs of nerve hyperplasia or increased small nerves adjacent to the involved cartilage which many think contributes to the acute sensitivity, often severe enough to send patients to the doctor for relief.

"A key diagnostic feature is the exquisite tenderness to palpation or pressure that is often associated with CNH. This pain is often the reason the patient presents for evaluation." (1)

"Lesions are most common in middle-aged white males with prevalence ratios between females to males of between 1:5 and 1:10. They are most common after the age of 40 years, with 90% of cases being reported between the ages of 50 and 80 years of age." (2)

This means that the number of cases will only continue to increase as baby boomers continue to reach advanced age and presently the best answer has been a home made prosthesis.

"Effective treatment of Chondrodermatitis nodularis chronica helicis (CNCH) As a result of this study, we recommend that patients presenting with CNCH be managed conservatively in the first instance . . . using a home-made, pressure-relieving prosthesis." (3)

"A pressure relieving prosthesis can be fashioned by cutting a hole from the center of a bath sponge." (4) All other presently available options, prosthetics, pressure pads and pillows, fall short of solving the problems for sufferers. They are faulty, in either size, construction, design, or composition.

Ear Pillow™, Sleep Easy R, CNH Pillow, and The Original Pillow with a hole are all large pillows with a hole cut from the middle. Tossing and positioning the head to match up with the recess in the pillow, is a painful endeavor by itself.

"Most commonly, the patient reports that the pain interferes with their ability to sleep at night." (5)

CNH Donut Pillow is a novel and necessary remedy, to the sleep deprivation CNH sufferers incur. It is feather-light and includes a strap, so it is portable, and moves with the head, ending the possibility of accidentally bumping or brushing the sore ear. This immediately prevents pain, reduces stress, and promotes a more natural, peaceful sleep.

"The primary treatment goal should be to relieve or eliminate pressure at the site of the lesion. This is often difficult because of the patient's preference, or necessity, to sleep on the side of the lesion. (6)

CNH Donut Pillow is specially designed to keep all contact from the injured ear area, and allow a person to sleep, even while laying directly on their preferred side, and lying on the injured ear.

HurtsDonut, and the Infinity Snake, are both reasonable options for people with CNH, but the first is a stuffed pillow fabricated to help heal ear piercings. All "stuffed pillows" have a tendency to splay and spread, like a bean bag, under the weight of the head.

The unique, contiguous foam, composition of the CNH Donut, and the novel "teardrop" shaped center hole, is very lightweight and soft, yet, provides enough strength to hold a 20 pound head up off an injured ear.

Neither of these pillows are prosthetics, that easily affix to the head itself. CNH Donut is a prosthetic that affixes to the head. CNH Donut is unique, in that it envelopes the affected area, in a perpendicular wall of foam, surrounding the lesion like a fortress. The pain of CNH is so intense, that there is also considerable psychological benefit, to having the injured ear protected thusly.

Many similar products, found in my Patent search, are cushions, of one sort or another, designed to increase circulation to an area, and reduce pressure to same. The most similar device I could find in my search of Patents was JP 3130592U, 3/2006, from Minako Institutions and the "Bedsore prevention freely Pillow, which is a pillow you may stuff to the desired fill and place where you need it. My pillow/prosthesis does not benefit or use stuffing or fill.

Very few patents shown are directed specifically to the ear and even fewer to this condition. (CNH) Most all of the devices discovered in my diligent search are pillows, stuffed and filled, with various materials, that lend themselves to spreading and splaying into the affected area. The smaller size and "contiguous" placement of thick foam bands, as opposed to a stuffing or fill, creates a unique opportunity to form the protective teardrop shape, by using the natural arc, and firm properties of the foam, to best advantage.

REFERENCES CITED 1, 2, 5, *Decision Support in Medicine*, Mary Maloney, Moncrieff, M. Sassoon, *Effective treatment of chondrodermatitis nodularis helicis using a conservative approach*, Br J Dermatol. Vol 150.2004 pp 892-4

4, 6, *Physician Assistant Review Guide*, by David Paulk and Donna Agnew, 2010 (pg 24)

3, National Institute of Health/PMID:15149500, May, 2004

CNH DONUT PILLOW
US PATENT DOCUMENTS

| | | | | |
|---|---|---|---|---|
| US D728272 | May 2015 | Zimmerman | Pressure Relief Pillow | D6/601 |
| US D773212 | July 2015 | Krishtul | Toroidal Seating Cushion | D6/601 |
| US D804852 | March 2016 | Glaze | Ear Pressure relief Travel Pillow | D6/601 |
| US D835431 | December 2017 | Bice | Pillow | D6/601 |
| U.S. Pat. No. 1,580,210 | March 1925 | McCulloch | Pillow | A47G9/10 |
| U.S. Pat. No. 2,111,147 | November 1937 | Antone | Ear Protector | A61F11/06 |
| U.S. Pat. No. 2,295,906 | October 1938 | Lacour | Pillow | A47G9/10 |
| U.S. Pat. No. 3,141,179 | July 1962 | McClean | Listening Pillow | A47G9/10 |
| U.S. Pat. No. 3,299,451 | Decmber 1964 | Thomas | Convertible Pillow | A47G9/10 |

-continued

| CNH DONUT PILLOW US PATENT DOCUMENTS | | | | |
|---|---|---|---|---|
| U.S. Pat. No. 3,574,397 | September 1968 | Norris | Orthopedic Pillow | A61F5/30 |
| U.S. Pat. No. 5,261,134 | November 1990 | Matthews | Infant Support Pillow | A47 D13/083 |
| U.S. Pat. No. 5,579,551 | December 1996 | Tommaney, | Arch Shaped Pillow Aparatus | A47G9/1009 |
| U.S. Pat. No. 5,836,024 | January 1997 | Uglehus, Birchall, Hawes, | Support Device | A61G7/075 |
| U.S. Pat. No. 6,052,848 | July 1998 | Kelly | Body Support Pillow | A47C20/021 |
| U.S. Pat. No. 6,363,285 | January 2000 | Wey | Therapeutic Sleeping Aid Device | A61F9/02 |
| U.S. Pat. No. 6,408,468 | July 2001 | Comfort | Pillow to facilitate Hearing | A47G9/10 |
| U.S. Pat. No. 6,546,579 | March 2000 | Leventhal, Thomas, | Conforming Air & Foam Support Device | A47G9/10 |
| U.S. Pat. No. 7,141,032 | March 200 | Flam, Bodine, Schanzer | Apparatus and Methods for Preventing and or/healing Pressure Ulcers | A61F13/69 |
| U.S. Pat. No. 7,461,424 | November 2005 | Lindell | Method and Apparatus for a pillow including foam pieces of various sizes | A47G9/10 |
| U.S. Pat. No. 8,863,338 | June 2011 | Dzioba, Wolf, Wyrick | Therapeutic support device allowing capillary blood flow | A61G7/05776 |
| U.S. Pat. No. 8,887,732 | July 2011 | Choi, Bhat | Method & devices for prevention and treatment of pressure ulcers | A61F5/34 |
| U.S. Pat. No. 9,220,345 | January 2013 | Davis, Caponi, Tabor | Pressure Relief Pillows | A47C7/022 |
| U.S. Pat. No. 9433309 | August 2013 | Cheng, Castillo | Pillow | A47G9/1054 |
| U.S. Pat. No. 10/111,526 | January 2012 | Davis, Caponi, Tabor | Pressure Relief Pillows | A47C7/022 |
| US 20080304691 | December 2008 | Lai | Sleep Aid System | 381/386 |
| US 20170095096 | 10/2015 | Mandell | Doughnut shaped multi function cushioning device | A63B21/4039 |
| US 2013019896 | January 2012 | Davis, Caponi, Tabor | Pressure Relief Pillow | A47C7/029 |

| INTERNATIONAL PATENT DOCUMENTS | | |
|---|---|---|
| ES 1023020U | November 1992 | Marquez Deogracias Ear Protector |
| KR 200216050Y1 | April 2000 | Mobilization Day Doughnut Style pillow with air cushion |
| CN 201906123U | December 2010 | Gu Zhai, Jing Li, Xiaoling ChenYing Physiotherapeutic pillow for preventing ear pressure sore |
| CN 204352079U | October 2014 | Hu Xiaoling, Pan Bi He Kui, Zheng Silin Fan Xianming Pressure Sore Cusion |
| JP 3130592U | March 2006 | Minako Institutions Bedsore prevention freely Pillow |

BRIEF SUMMARY OF THE INVENTION

Invention is a pressure relieving, ear protecting, prosthesis, and sleep aid.

The invention is a soft and light, but rigid and strong, generally toroidial shaped, pressure relieving, ear protecting prosthesis, to be used in conjunction with a standard pillow, for patients diagnosed with CNH.

Comprised of 2, contiguous, foam strips, curved into a tear-drop, or lachrymiform shape (FIG. 1) with ends stitched together. Covered in cylindrical, nylon, spandex fabric, (FIG. 2)

Affixed with a head strap (FIG. 3)

So patient may return to sleeping on the preferred side. (FIG. 4)

The contiguous polyurethane foam design, creates a base strong enough to hold a head. No filling or stuffing, which has tendency to spread out under pressure. The oculiform or lachrymiform, shaped aperture, resists splaying. The smaller size, envelopes the ear, offering better protection from outside contact.

Can be used before, and after surgical treatment for CNH, or to facilitate healing without surgery. Inexpensive and user friendly.

DETAILED DESCRIPTION OF THE INVENTION

CNH Donut Pillow is a pressure relieving, ear protecting, prosthesis, and sleep aid.

A soft and light, but rigid and strong, generally toroidial shaped, pressure relieving prosthesis, which protects the ear, to be used in conjunction with a standard pillow, for patients diagnosed with CNH.

Figure 1:
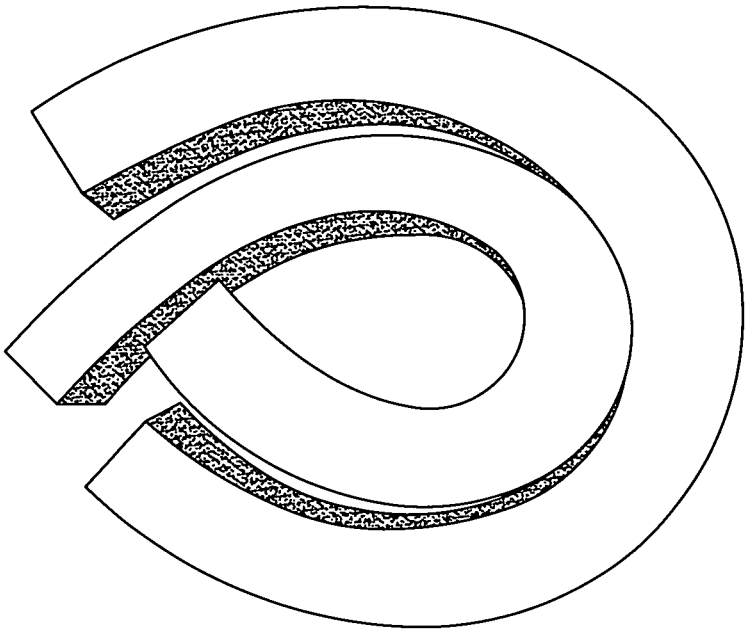
FIG. 1 shows the two contiguous foam strips curved into a tear-drop shape.
Figure 2:
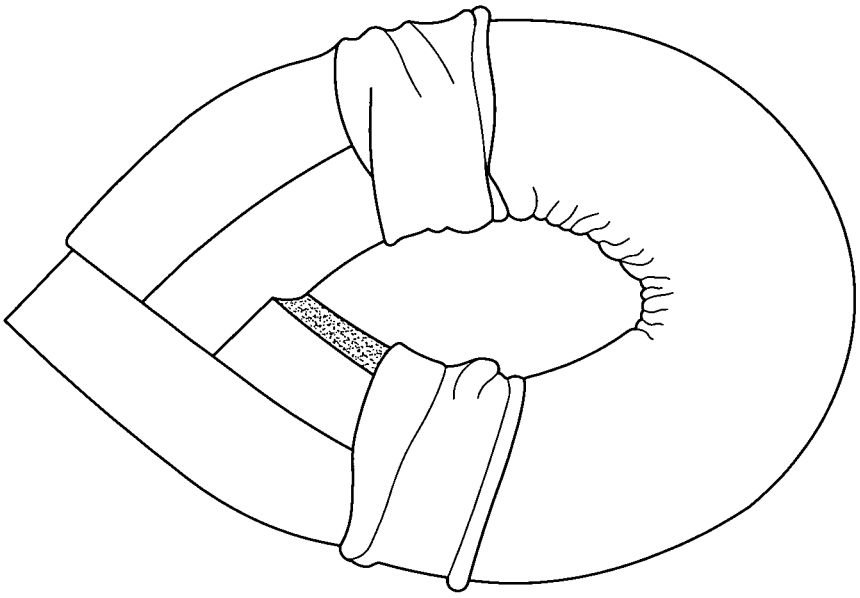
FIG. 2 shows the foam strips covered in the nylon spandex fabric.
Figure 3:
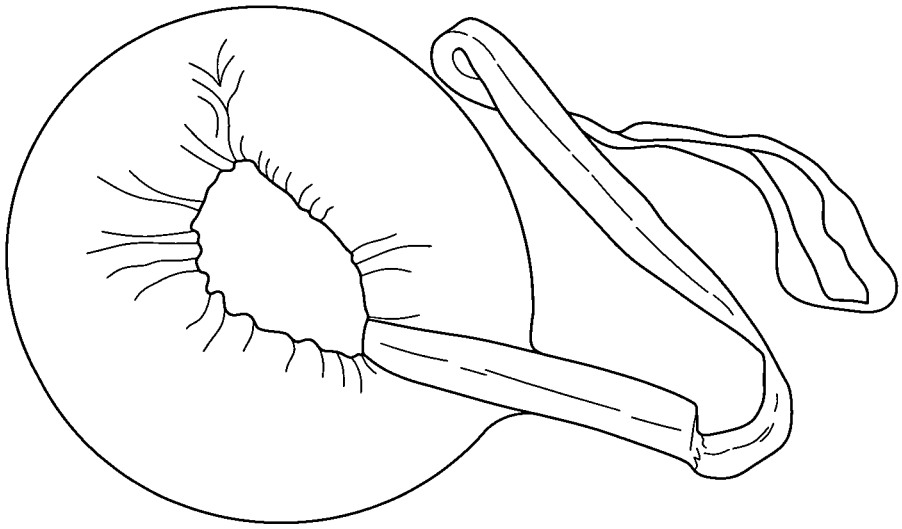
FIG. 3 shows the assembled CNH Donut Pillow including a head strap.
Figure 4:
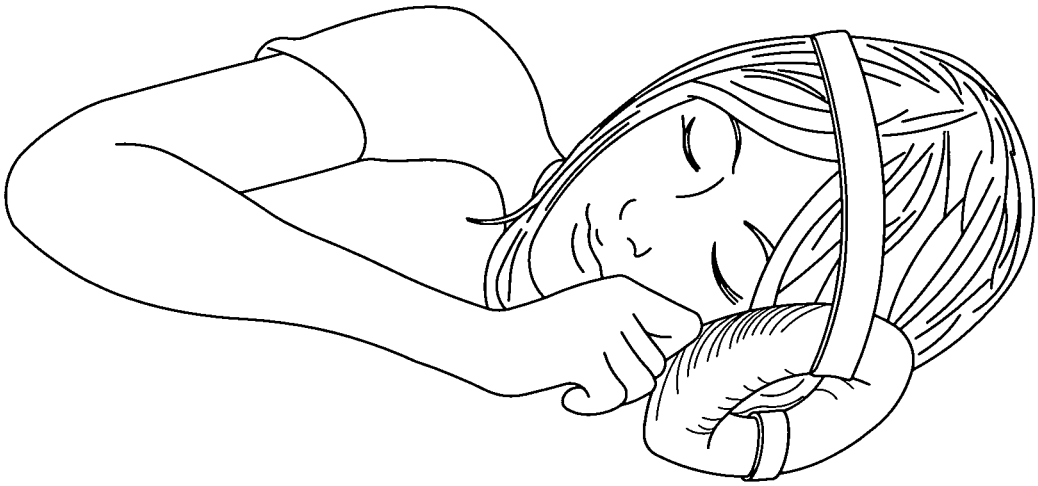
FIG. 4 shows the device being used while sleeping.

Comprised of 2, unequal lengths of untreated, polyurethane foam, 38 cm×2.5 cm×4.5 cm, and 45.5 cm×2.5 cm×4.5 cm, placed next to each other and curved, into a 4 cm×7 cm tear-drop or lachrymiform shaped hole (FIG. 1). These are held together, and carefully inserted into a soft, nylon-spandex sheath, 37 cm long and 13 cm around. (FIG. 2) The hole is reformed, trimmed if necessary; then the ends of the foam are sewn together. Then the sheath is pulled the rest of the way around and sewn up, completing a 2.5 cm thick, 15 cm long×12.5 cm wide, donut shape. A soft elastic band, 1.4 cm wide and 79.5 cm long, is affixed with hook and loop fastener (1 cm×2 cm) at both ends, and at 20 cm, and 58 cm. This is attached to the completed donut pillow. (FIG. 3) and used to keep it in place for sleep. (FIG. 4)

The claimed invention is:

1. A device for protecting a user's ear while sleeping comprising:

two contiguous strips of foam defined by a shorter strip and a longer strip having unequal lengths, each strip having a first end and a second end, the first and second ends of each strip being attached together to create a teardrop shape having an opening, the opening created by the longer strip receives the shorter strip and the opening created by the shorter strip is sized and configured to receive the user's ear;

a fabric tube covering the two strips; and a head strap affixed to the strips and configured to secure the device in place on the user's head with the user's ear located within the opening created by the shorter strip.

2. The device of claim 1, wherein the head strap is affixed to the strips with hook and loop fasteners.

3. The device of claim 1, wherein the shorter strip is 38 cm long and the longer strip is 45.5 cm long.

* * * * *